US010159346B2

(12) United States Patent
Huang

(10) Patent No.: US 10,159,346 B2
(45) Date of Patent: Dec. 25, 2018

(54) LIFTING DEVICE FOR ARMREST

(71) Applicant: Yi-Jen Huang, Changhua County (TW)

(72) Inventor: Yi-Jen Huang, Changhua County (TW)

( * ) Notice: Subject to any disclaimer, the term of this patent is extended or adjusted under 35 U.S.C. 154(b) by 0 days.

(21) Appl. No.: 15/597,467

(22) Filed: May 17, 2017

(65) Prior Publication Data

US 2018/0014647 A1 Jan. 18, 2018

(30) Foreign Application Priority Data

Jul. 15, 2016 (TW) ..... 105210729 U

(51) Int. Cl.
*A47C 1/03* (2006.01)

(52) U.S. Cl.
CPC ..... *A47C 1/03* (2013.01)

(58) Field of Classification Search
None
See application file for complete search history.

(56) References Cited

U.S. PATENT DOCUMENTS 3,759,565 A * 9/1973 Ferneau ..... A61G 1/0562 108/82
5,588,766 A * 12/1996 Lai ..... A45B 19/06 248/297.31
6,062,646 A * 5/2000 Bock ..... A47C 1/03 248/118.3
6,824,218 B1 * 11/2004 van Hekken ..... A47C 1/03 297/411.36
8,156,586 B2 * 4/2012 Reed ..... A61G 1/0567 296/20
2015/0123447 A1 * 5/2015 Warren, Jr. ..... A61G 7/051 297/411.32

* cited by examiner

*Primary Examiner* — David E Allred

(57) ABSTRACT

A lifting device for an armrest contains: a first fitting tube, a second fitting tube, and a holder. The first fitting tube includes a connector, a hollow part, a first channel, and a second channel. The first channel has a vertical section and a hollow section, the second channel has an operation area, multiple positioning teeth, multiple limitation areas, plural protrusions, and multiple defining recesses. The second fitting tube is hollow and includes a lateral part and a longitudinal part fitted on an outer wall of the lateral part of the first fitting tube, and the longitudinal part has a projection arranged on an inner wall of the longitudinal part and housed in one of the multiple defining recesses. The holder is mounted on a top of the lateral part of the second fitting tube.

8 Claims, 10 Drawing Sheets

LIFTING DEVICE FOR ARMREST

FIELD OF THE INVENTION

The present invention relates to a chair, and more particularly to a lifting device for an armrest which is simplified and enhances using effect.

BACKGROUND OF THE INVENTION

A conventional lifting device is mounted on each of two armrests of a chair so as to adjust a height of each armrest.

The conventional lifting device contains a first movable tube and a second movable tube fitted on the first movable tube, and the second movable tube has a flexible button fixed thereon, the first movable tube has multiple orifices so that after the flexible button is pressed, a flexible projection extends out of or retracts into one of the multiple orifices, hence a height of each of the first movable tube and the second movable tube is adjusted. However, the conventional lifting device is complicated and is assembled troublesomely.

The present invention has arisen to mitigate and/or obviate the afore-described disadvantages.

SUMMARY OF THE INVENTION

The primary objective of the present invention is to provide a lifting device for an armrest which contains a first channel and multiple positioning teeth so as to simplify related components and to operate the lifting device easily.

To obtain the above objective, a lifting device provided by the present invention contains: a first fitting tube, a second fitting tube, and a holder.

The first fitting tube includes a connector fixed on a bottom of the first fitting tube, a hollow part perpendicular to the connector, and a first channel formed on a peripheral wall of the hollow part. The first channel has a vertical section and a hollow section, the vertical section communicates to a top of the hollow part, the horizontal section forms on one end of the first channel opposite to the vertical section, the first fitting tube further includes a second channel axially extending along the hollow part adjacent to the horizontal section. The second channel has an operation area axially formed along the hollow part, multiple positioning teeth axially arranged in the second channel and located adjacent to the operation area, multiple limitation areas separately formed among the multiple positioning teeth, each of plural protrusions formed between each positioning tooth and the operation area, and each of multiple defining recesses formed between each positioning tooth and each protrusion and away from the connector.

The second fitting tube is hollow and includes a lateral part and a longitudinal part fitted on an outer wall of the lateral part of the first fitting tube, and the longitudinal part has a projection arranged on an inner wall of the longitudinal part and housed in one of the multiple defining recesses.

The holder is mounted on a top of the lateral part of the second fitting tube.

Preferably, the first fitting tube further includes a stop face defined between the second channel and the top of the hollow part.

Preferably, a highest position of each protrusion away from the connector is a highest position of each defining recess.

Preferably, each defining recess is in a semicircle shape or in a rectangle shape.

Preferably, the projection of the second fitting tube is housed in the one defining recess by using a gravitational force.

Preferably, a height between each protrusion of the first fitting tube and each positioning tooth is more than or equal to a diameter of the projection.

Preferably, a width of the first channel is more than or equal to a diameter of the projection.

Preferably, a longitudinal width of the operation area of the second channel is larger than or equal to a diameter of the projection.

DETAILED DESCRIPTION OF THE PREFERRED EMBODIMENTS

Figure 1:
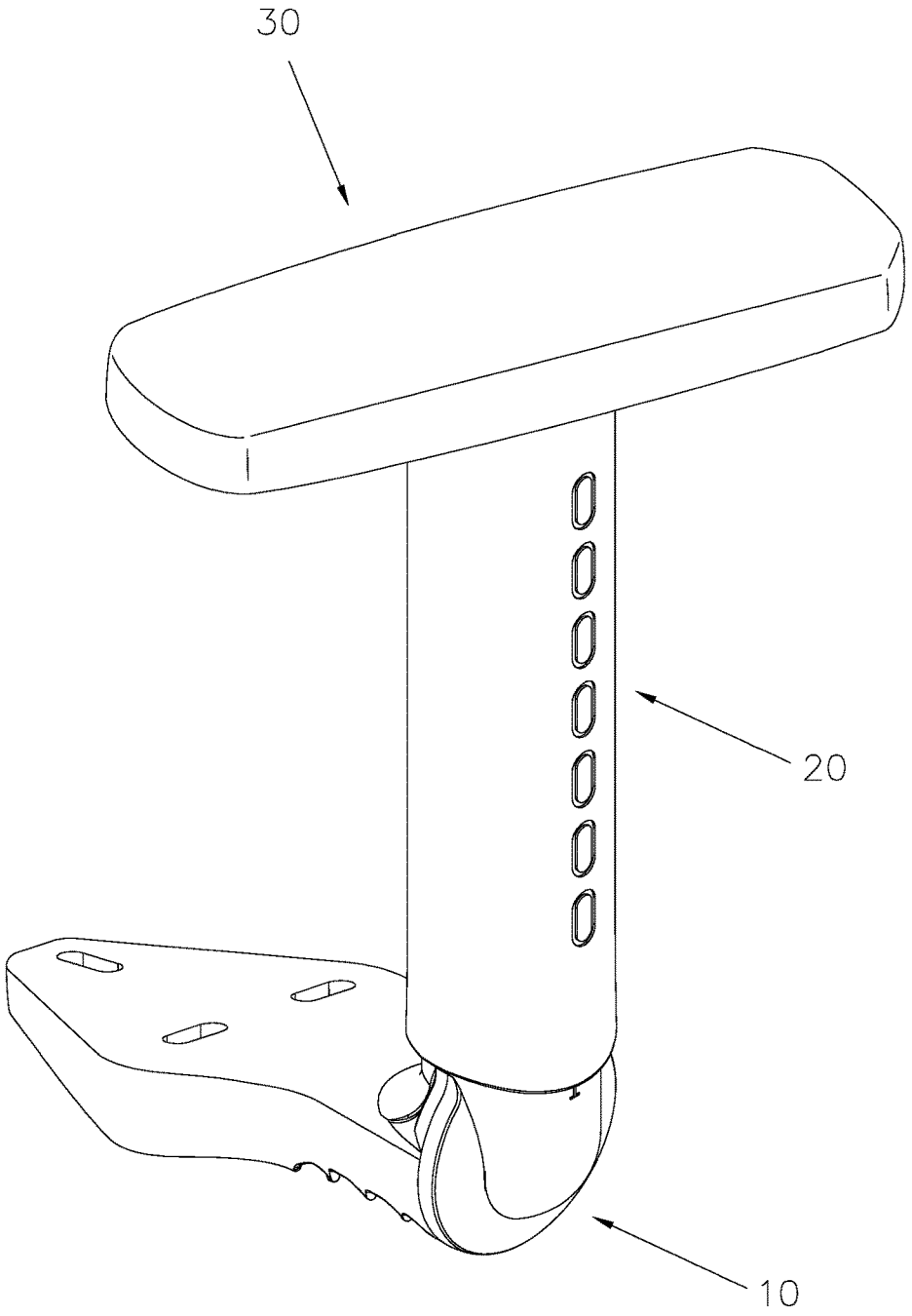
FIG. 1 is a perspective view showing the assembly of a lifting device for an armrest according to a preferred embodiment of the present invention.
Figure 2:
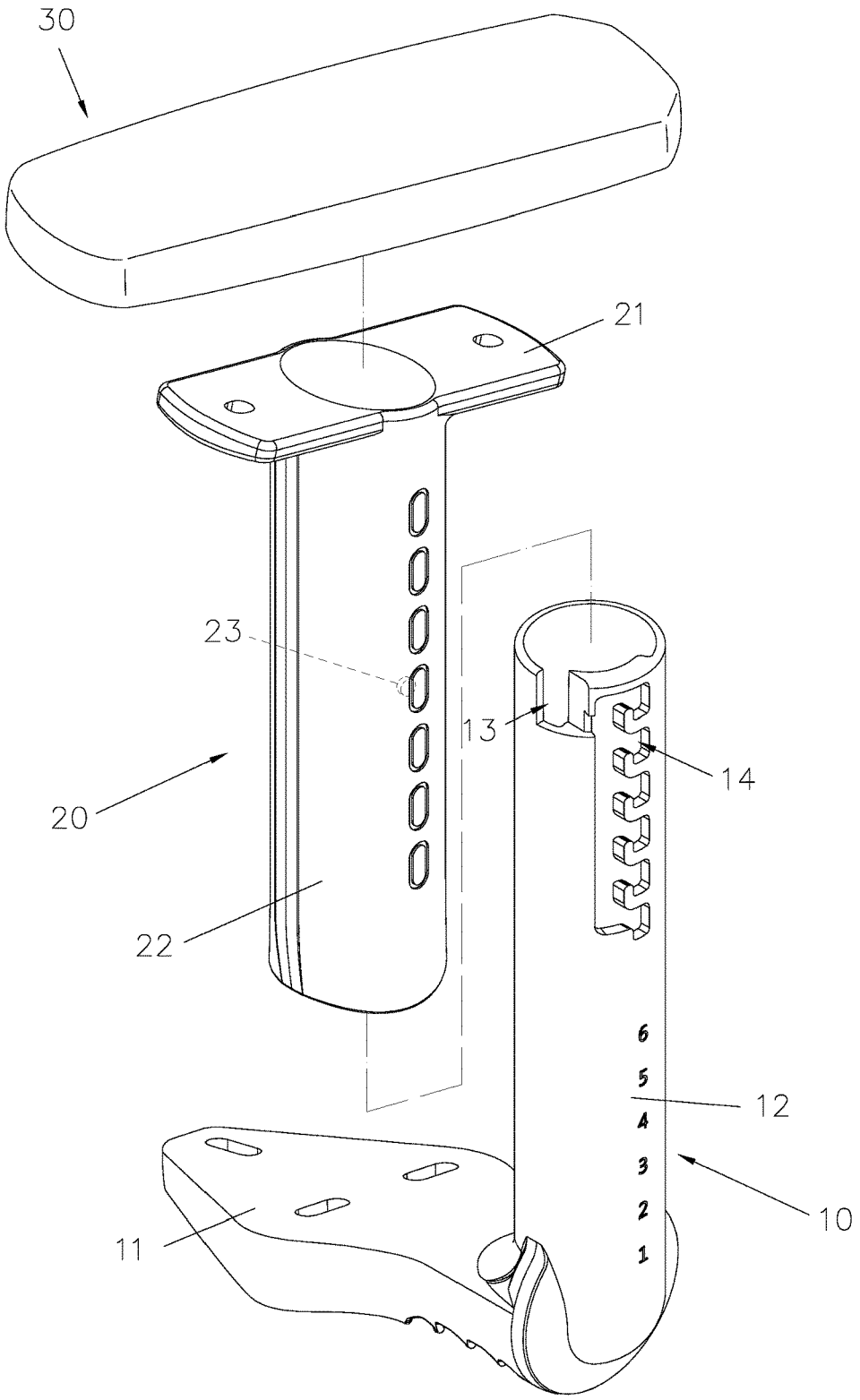
FIG. 2 is a perspective view showing the exploded components of the lifting device for the armrest according to the preferred embodiment of the present invention.
Figure 3:
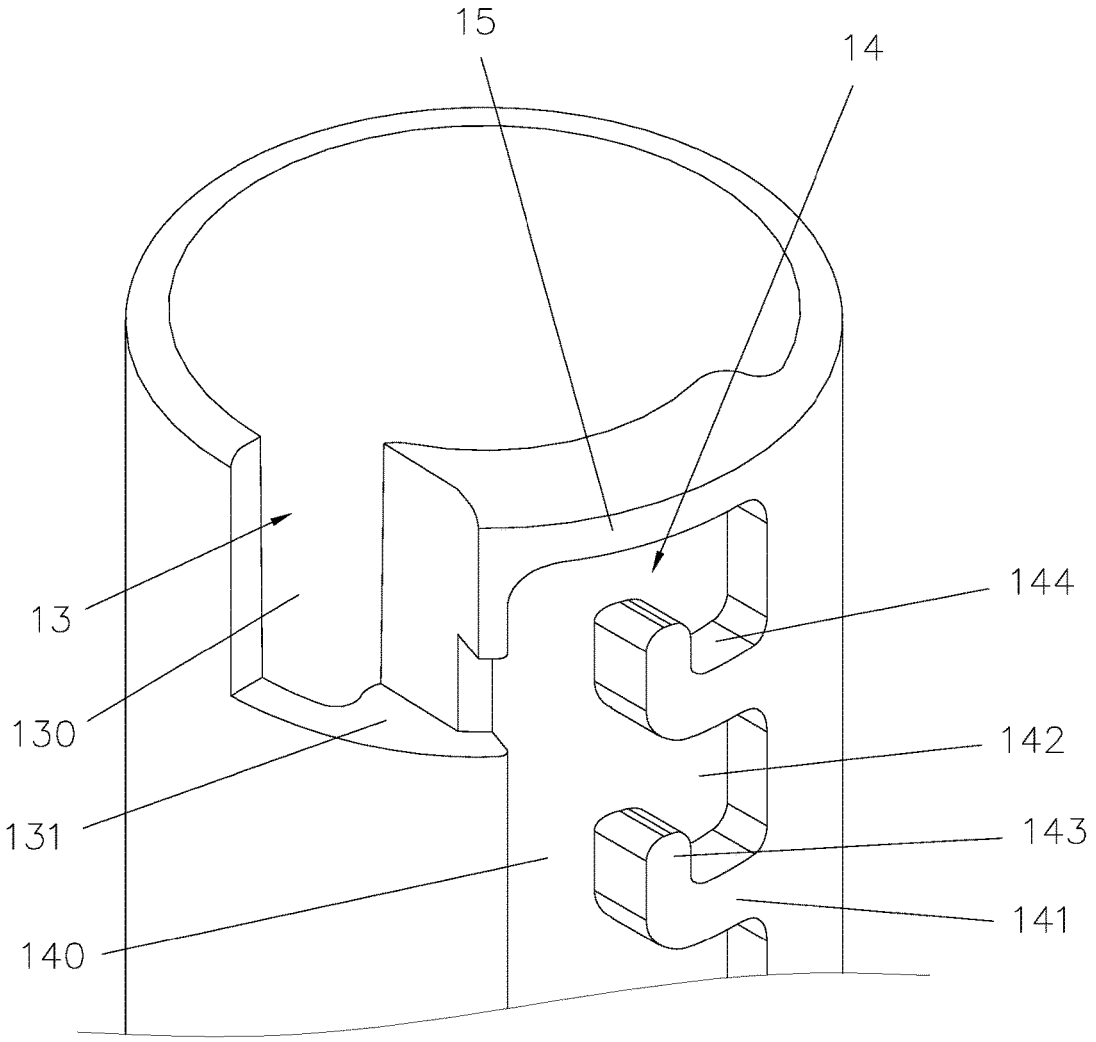
FIG. 3 is a perspective view showing the assembly of a first fitting tube of the lifting device for the armrest according to the preferred embodiment of the present invention.
Figure 4:
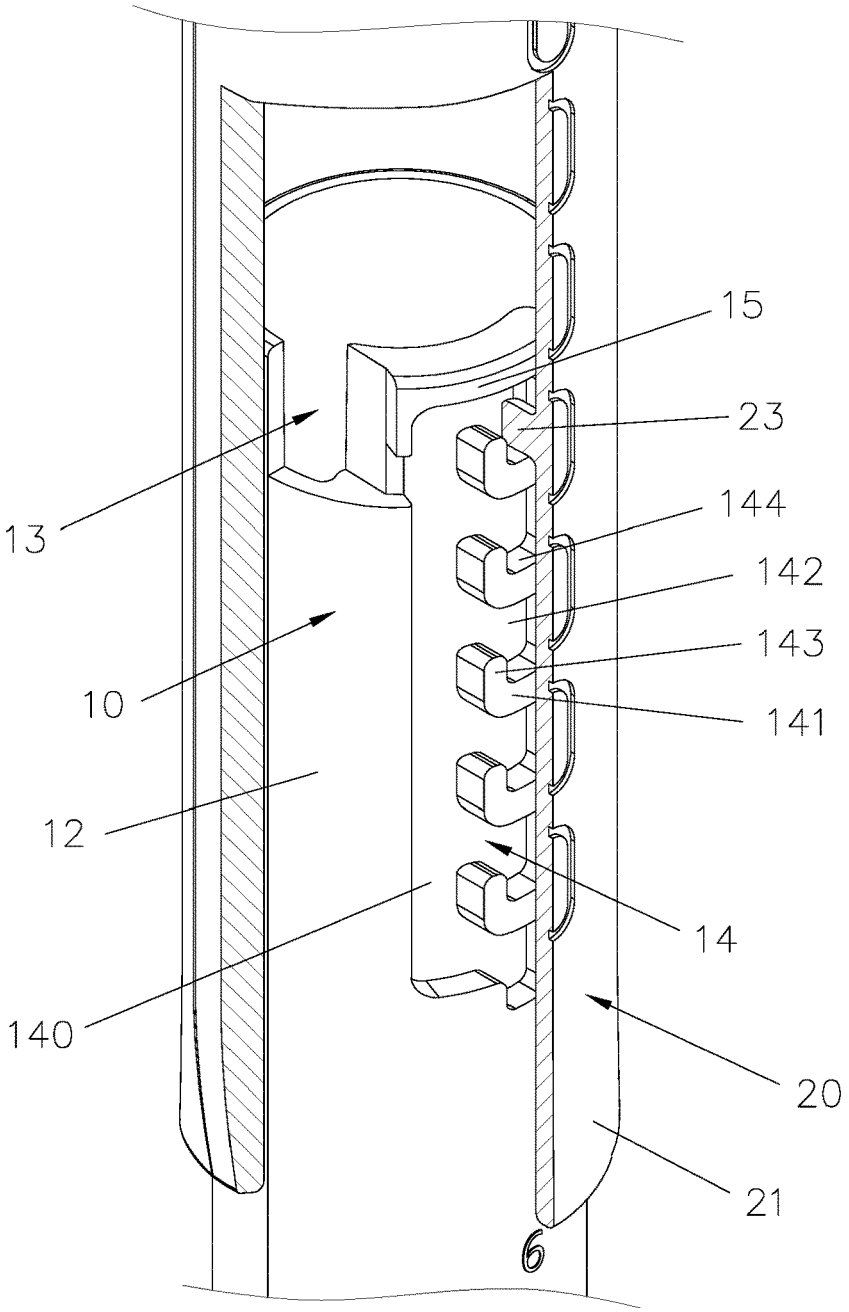
FIG. 4 is a cross-sectional perspective view showing the assembly of the lifting device for the armrest according to the preferred embodiment of the present invention.

With reference to FIGS. 1 to 4, a lifting device according to a preferred embodiment of the present invention is fixed on each of two sides of a chair seat and comprises: a first fitting tube 10, a second fitting tube 20, and a holder 30.

The first fitting tube 10 includes a connector 11 fixed on a bottom thereof and configured to connect with the chair seat, a hollow part 12 perpendicular to the connector 11, and a first channel 13 formed on a peripheral wall of the hollow part 12, wherein the first channel 13 has a vertical section 130 and a hollow section 131, the vertical section 130 communicates to a top of the hollow part 12, the horizontal section 131 forms on one end of the first channel 13 opposite to the vertical section 130. The first fitting tube 10 further includes a second channel 14 axially extending along the hollow part 12 adjacent to the horizontal section 131, a stop face 15 defined between the second channel 14 and the top of the hollow part 12, wherein the second channel 14 has an operation area 140 axially formed along the hollow part 12, multiple positioning teeth 141 axially arranged in the second channel 14 and located adjacent to the operation area 140, one of multiple limitation areas 142 formed between the stop face 15 and a topmost positioning tooth 141, the other of the multiple limitation areas 142 separately formed among the multiple positioning teeth 141, each of plural protrusions 143 formed between each positioning tooth 141 and the operation area 140, and each of multiple defining recesses 144 formed between each positioning tooth 141 and each protrusion 143 and facing the stop face 15, wherein a highest position of each protrusion 143 facing to the stop face 15 is a highest position of each defining recess 144, and each defining recess 144 is in any shapes, such as in a semicircle shape or in a rectangle shape.

The second fitting tube 20 is hollow and includes a lateral part 21 and a longitudinal part 22 fitted on an outer wall of the lateral part 21 of the first fitting tube 10, and the longitudinal part 22 has a projection 23 arranged on an inner wall thereof and housed in one of the multiple defining recesses 144 by using a gravitational force, a height between each protrusion 143 and each positioning tooth 141 is more than or equal to a diameter of the projection 23, and a width of the first channel 13 is more than or equal to the diameter of the projection 23, a longitudinal width of the operation area 140 of the second channel 14 is larger than or equal to the diameter of the projection 23 so that the projection 23 moves in the second channel 14 and selectively fixes in any one of the multiple defining recesses 144.

The holder 30 is mounted on a top of the lateral part 21 of the second fitting tube 20.

Referring to FIGS. 1 to 4, the holder 30 is fixed on the top of the lateral part 21 of the second fitting tube 20, the longitudinal part 22 of the second fitting tube 20 is fitted on an outer wall of the hollow part 12, and the projection 23 of the longitudinal part 22 is moved into the vertical section 130 of the first channel 13 of the hollow part 12, the holder 30 is rotated so as to drive the second fitting tube 20 and the projection 23, and the projection 23 moves to the second channel 14 along the horizontal section 131 and fixes in one of the multiple defining recesses 144 by using the projection 23, thus connecting the lifting device easily and quickly.

Figure 5:
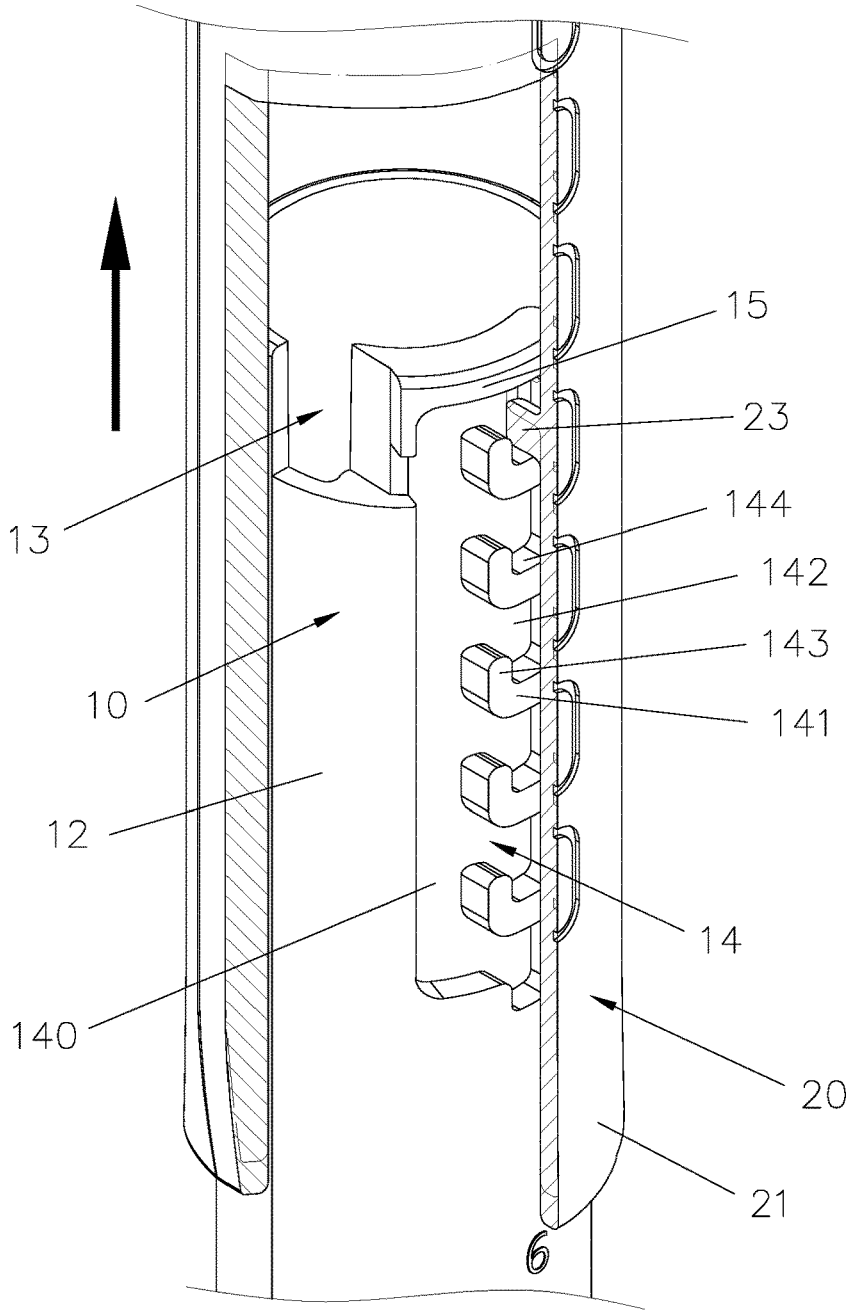
FIGS. 5-10 are a cross-sectional perspective view showing the assembly of the lifting device for the armrest according to the preferred embodiment of the present invention.
Figure 6:
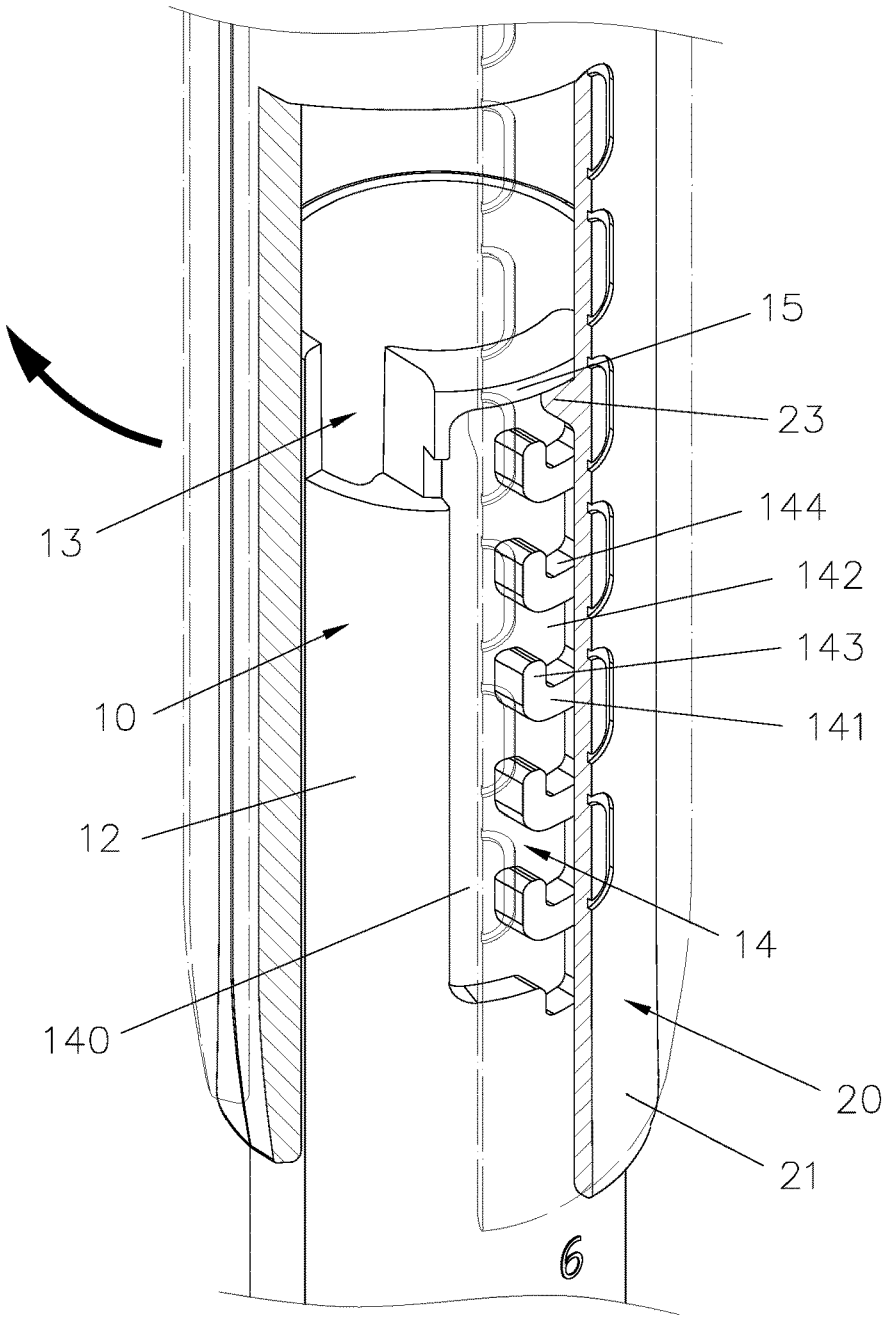
Figure 7:
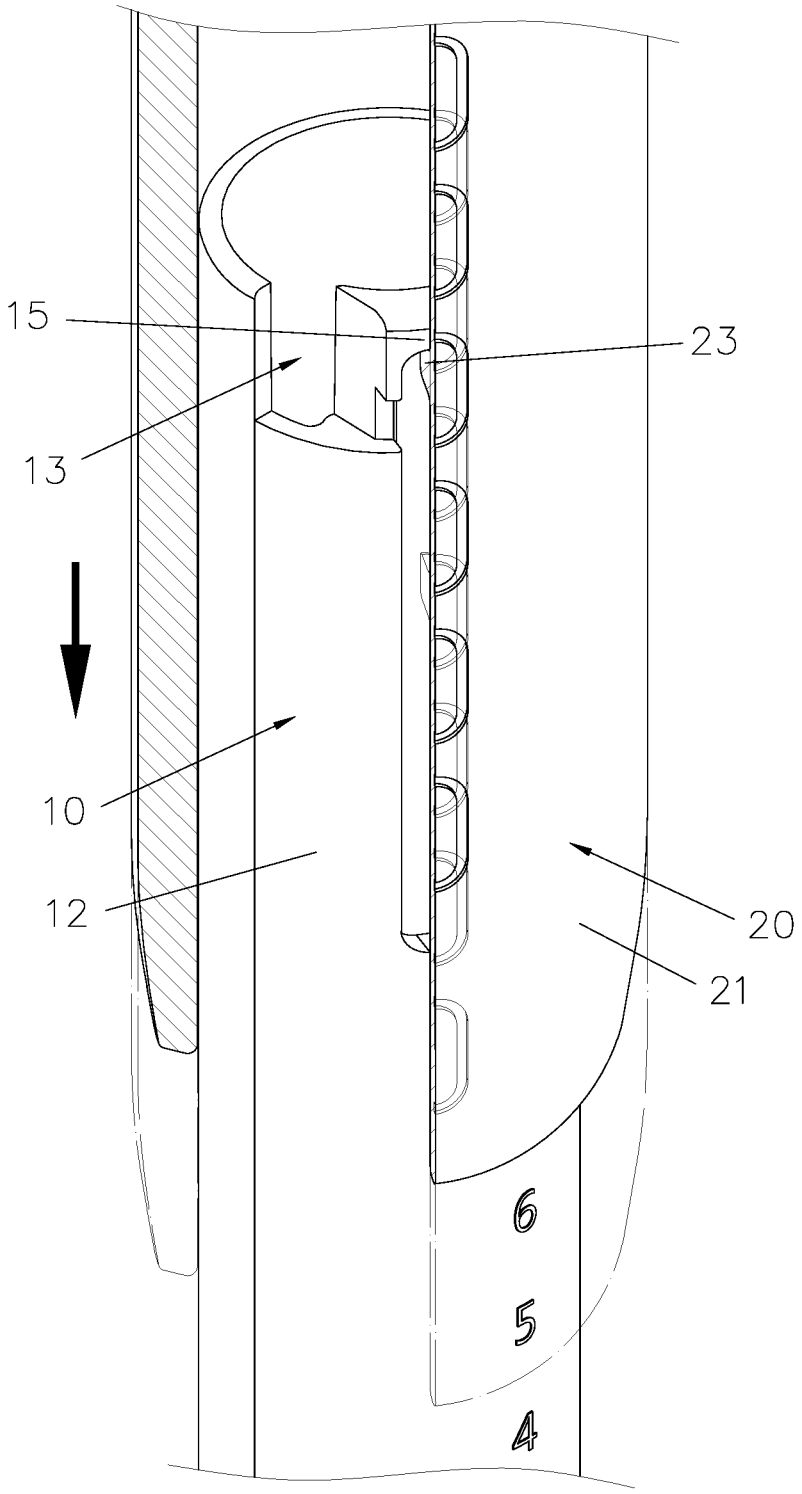
Figure 8:
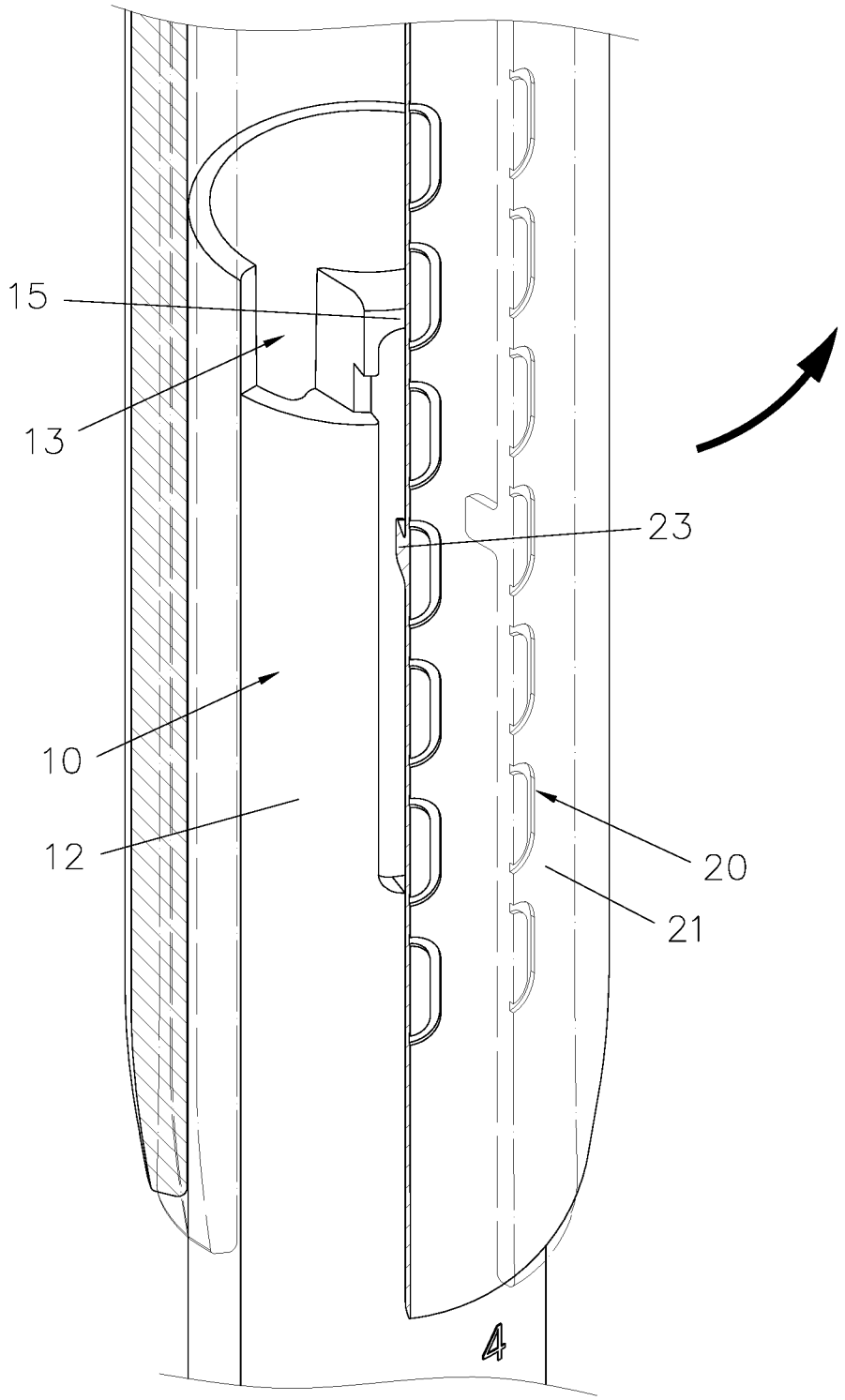
Figure 9:
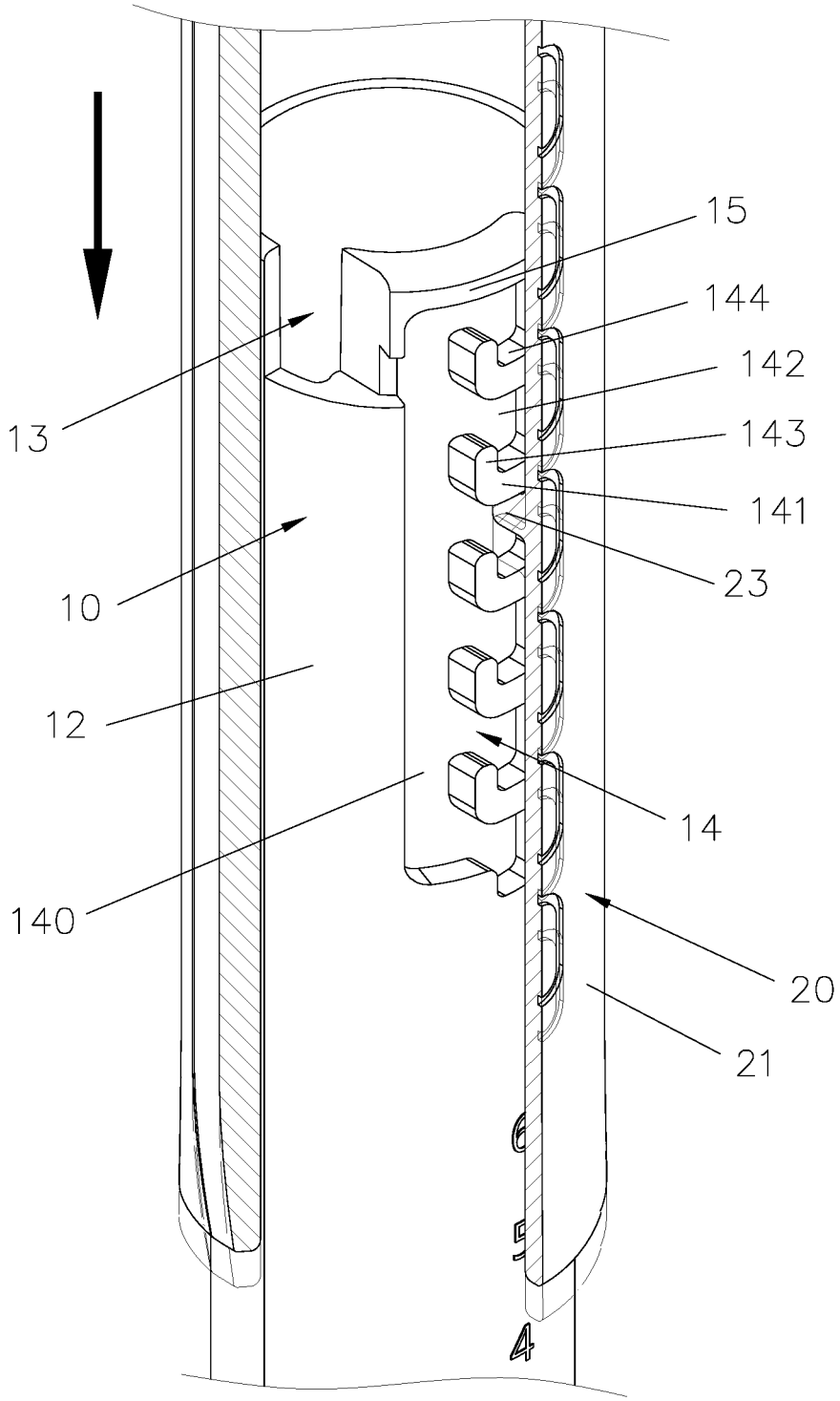
Figure 10:
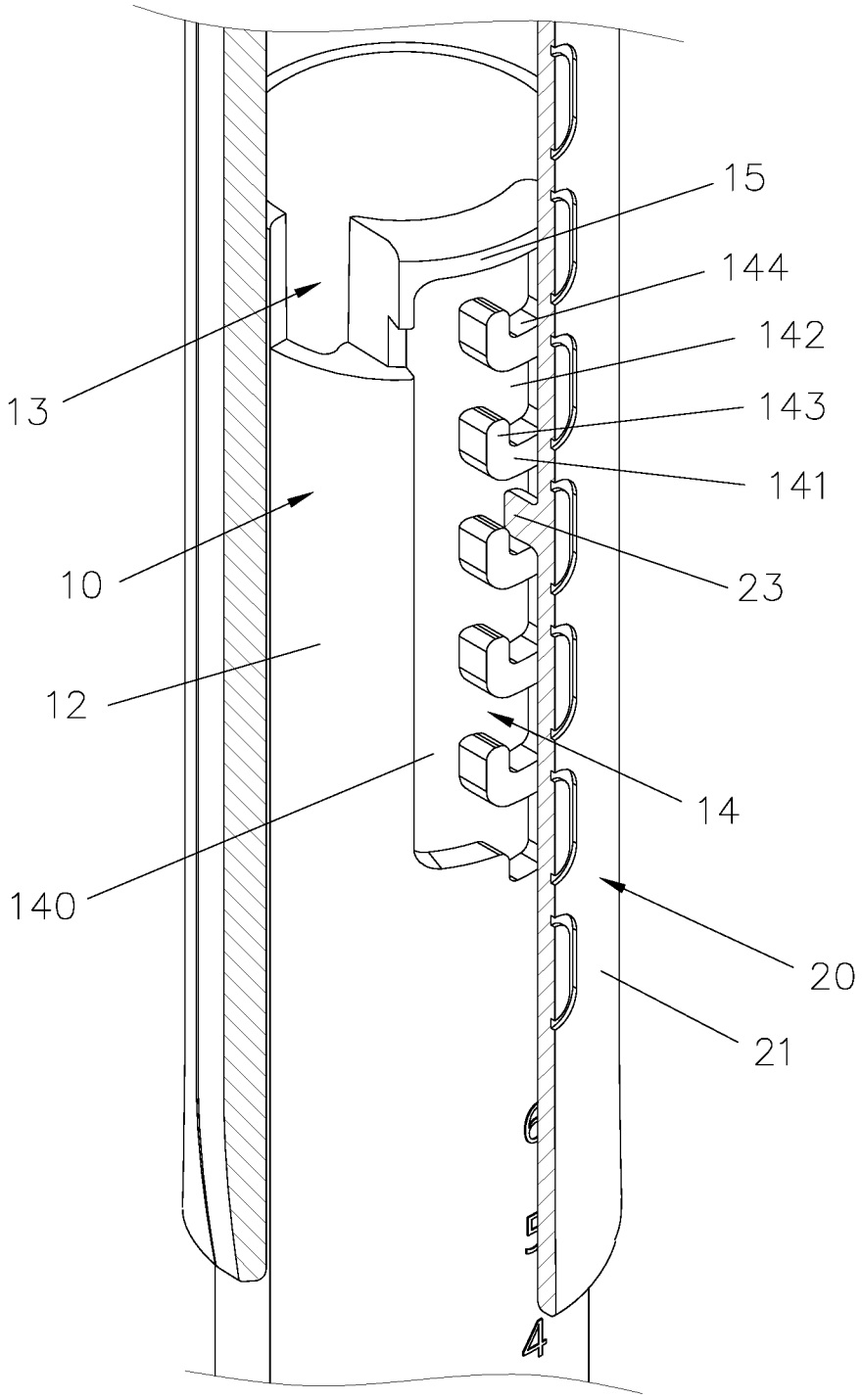

Referring to FIGS. 5-10, as adjusting a height of an armrest, the holder 30 is lifted upwardly so as to drive the second fitting tube 20 and the projection 23 to move upwardly. After the projection 23 is stopped by one of the multiple positioning teeth 141 or the stop face 15, the holder 30 actuates the projection 23 to revolve so that the projection 23 removes from two adjacent positioning teeth 141 so as to move into the operation area 140, thus adjusting a height of the holder 30 based on using requirement. Thereafter, the projection 23 rotates into two adjacent positioning teeth 141 and is fixed in one of the multiple defining recesses 144 by way of the gravitational force. Each of the plural protrusions 143 is formed between each positioning tooth 141 and each defining recess 144 of the operation area 140, so when the holder 30 is rotated by an external force, the projection 23 is stopped by each protrusion 143 so as to avoid a removal. As moving the holder 30 to a highest height, the projection 23 is stopped by the stop face 15 and does not remove from the second channel 14 so as to prevent a removal of the second fitting tube 20 from the first fitting tube 10, thus enhancing using safety and stability.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A lifting device for an armrest comprising:

a first fitting tube including a connector fixed on a bottom of the first fitting tube, a hollow part perpendicular to the connector, and a first channel formed on a peripheral wall of the hollow part, the first channel having a vertical section and a horizontal section, the vertical section opening out through a top end of the hollow part, the horizontal section being formed on one end of the first channel opposite to the vertical section, the first fitting tube further including a second channel axially extending along the hollow part adjacent to the horizontal section, the second channel having an operation area formed along a vertical portion of the hollow part, multiple positioning teeth axially arranged in the second channel and located adjacent to the operation area, multiple limitation areas separately formed among the multiple positioning teeth, each of plural protrusions formed between each positioning tooth and the operation area, and each of multiple defining recesses formed between each positioning tooth and each protrusion and away from the connector;

a second fitting tube being hollow and including a horizontal part and a longitudinal part fitted on an outer wall of the hollow part of the first fitting tube, and the longitudinal part having a projection arranged on an inner wall of the longitudinal part and housed in one of the multiple defining recesses; and a holder mounted on a top of the horizontal part of the second fitting tube.

2. The lifting device as claimed in claim 1, wherein the first fitting tube further includes a stop face defined between the second channel and the top of the hollow part.

3. The lifting device as claimed in claim 1, wherein a highest position of each protrusion away from the connector is a highest position of each defining recess.

4. The lifting device as claimed in claim 1, wherein each defining recess is in a semicircle shape or in a rectangle shape.

5. The lifting device as claimed in claim 1, wherein the projection of the second fitting tube is housed in the one defining recess by using a gravitational force.

6. The lifting device as claimed in claim 1, wherein a height between each protrusion of the first fitting tube and each positioning tooth is more than or equal to a diameter of the projection.

7. The lifting device as claimed in claim 1, wherein a width of the first channel is more than or equal to a diameter of the projection.

8. The lifting device as claimed in claim 1, wherein a longitudinal width of the operation area of the second channel is larger than or equal to a diameter of the projection.

* * * * *